United States Patent [19]

Colburn

[11] Patent Number: 4,488,323

[45] Date of Patent: Dec. 18, 1984

[54] BED SHEETS WITH HOOK AND LOOP FASTENERS

[76] Inventor: Harry E. Colburn, P.O. Box 1093, Lake Havasu City, Ariz. 86403

[21] Appl. No.: 314,279

[22] Filed: Oct. 23, 1981

[51] Int. Cl.[3] ..... A47G 9/04

[52] U.S. Cl. ..... 5/460; 5/496

[58] Field of Search ..... 5/460, 498, 496, 495, 5/482, 497

[56] References Cited

U.S. PATENT DOCUMENTS

| | | | |
|---|---|---|---|
| 3,066,323 | 12/1962 | Kintner | 5/496 |
| 3,530,487 | 9/1970 | Beer | 5/496 |
| 3,603,639 | 9/1971 | Wilson | 5/498 |
| 3,857,124 | 12/1974 | Hadley | 5/496 |
| 4,144,602 | 3/1979 | Fernandes | 5/496 |
| 4,301,561 | 11/1981 | McLeod | 5/498 |

*Primary Examiner*—Alexander Grosz

*Attorney, Agent, or Firm*—Drummond & Nissle

[57] ABSTRACT

Bedding. A pair of strips of hook and loop fastening material are attached to and circumscribe the side of a mattress. The strips are positioned on the side of the mattress one above the other. Strips of hook and loop fastening material are also attached to the undersurfaces and near the outer peripheral edges of top and bottom sheets on the mattress. The bottom sheet is smaller than the top sheet so that the strip of fastening material on the bottom sheet is attached to the upper strip of fastening material on the side of the mattress. The strip of fastening material on the top sheet is attached to the lower strip of fastening material on the side of the mattress. The strips of fastening material attached to the undersurfaces of the top and bottom sheets are fabricated from hook material and the strips of fastening material attached to the side of the mattress fabricated from loop material, or vice versa.

2 Claims, 7 Drawing Figures

BED SHEETS WITH HOOK AND LOOP FASTENERS

This invention relates to an improved bedding attachment system.

More particularly, the invention relates to an improved bedding attachment system which permits fitted sheets to be quickly and conveniently secured in place on and removed from a mattress without having to lift the ends of the mattress or tuck the sheets underneath the mattress.

In a further respect, the invention relates to an improved bedding system in which bedding placed on waterbeds stays in proper position on the waterbed during movement of water in the waterbed mattress.

In another aspect, the invention pertains to an improved bedding system in which fitted sheets are attached and maintained in position over a mattress by a continuous strip of fastening material positioned adjacent the side surfaces of the mattress such that forces acting on the fastening strip due to tension in the sheet are generally evenly distributed along the fastening strip.

The conventional unfitted or flat bedsheet has long been used as the bottom sheet to cover a springbed mattress. This kind of sheet is desirable because it will fit various sized mattresses and may, if necessary, be positioned on a mattress one side at a time by tucking the sheet between the mattress and springs. The ability to position a flat bedsheet on a mattress without having to lift the corners or sides of the mattress is especially useful in hospitals where raising the mattress could cause discomfort to a bedridden patient. However, flat bedsheets easily work loose and become creased during normal movement of a person sleeping on a bed. The creases or wrinkles formed in the sheet are irritating to the person using the bed and, over long periods of time, promote the formation of bedsores.

Contoured or fitted sheets overcome some of the problems associated with flat bedsheets by sewing an elastic strip around the bottom of the corners of the sheet to create pockets which fit around the four corners of a mattress. In placing a contoured sheet on a mattress, three corner pockets of the sheet are fitted around three mattress corners and the remaining corner of the mattress is then lifted up to slip the fourth pocket of the sheet over this corner of the mattress. When the mattress corner is lowered to its original position, the fitted sheet is stretched taut across the top and corners of the mattress. The principal disadvantage of the contoured sheet is that tension in the sheet is concentrated at and causes the corners of the sheet to tear before the sheet fabric has worn out. In addition, having to lift at least one corner of a mattress when installing the sheet makes it difficult for the elderly and handicapped to use the sheet and makes use of the sheet in hospitals awkward when it is not possible to move a patient from a bed to change sheets.

Waterbed mattresses are particularly difficult to satisfactorily cover with sheets or mattress pads. These mattresses comprise a rectangular rubber or plastic container which, when filled with water, is about 8–10 inches high. Attempting to use a normal unfitted flat bedsheet as the bottom sheet on a waterbed is not desirable because the sheet is rapidly pulled loose from underneath the mattress when a person sits or lies on the bed and sets in motion cyclical waves which travel through the water contained in the mattress. These waves repeatedly move into and out of the corners of the mattress and alternately expand and decrease the size of the corners of the mattress. At the same time, the top surface of the mattress and the sheet area covering the top of the mattress are under tension and tend to inwardly pull and raise the corners of the mattress. The combination of wave motion of the water and of tensile forces on the sheet and top of the mattress results in the corners of the sheet being torn or in the sheet being rapidly worked loose, or both. The cyclical collapsing of the corners of the waterbed caused by the wave motion of water which results when a person sits or lies on the bed also permit the pockets of contoured sheets to work free from the corners of a waterbed mattress.

The use of hook and loop fastening material commonly sold under the VELCRO trademark strips on bedding and on mattresses to facilitate the positioning of the bedding on the mattress is well known. See for example U. S. Pat. Nos. 4,040,133 to Gilreath; 3,965,504 to Ainsworth; 3,066,323 to Kintner; 4,045,832 to DiForti, et al.; 4,144,602 to Fernandes; 3,832,743 to Smith and 3,243,827 to Kintner. Several disadvantages are commonly associated with such known bedding systems. Hook and loop fastening materials strips carried by sheets or mattress covers used in prior art bedding systems normally must be attached to opposing hook and loop fastening material strips which are positioned underneath a mattress or located near the bottom of the mattress. Thus, these systems propagate the age old inconvenience of having to lift the mattress to put a sheet on the mattress or of having to move the bed away from a wall to do so. In the case of the elderly and physically handicapped, lifting and reaching under the corners of a mattress often is simply not practical.

Another problem associated with prior art bedding systems is that several small hook and loop fastening strips material are often positioned at each corner of a sheet so that when the sheet is put over a mattress a cup or pocket is formed in each of the four corners of the sheet. Each cup or pocket fits around one of the corners of the mattress. With this type of arrangement, the large proportion of the force exerted by a mattress on a tight fitting sheet is at the corners of the sheet and results in a combination of shear, torque and outwardly pulling tensile forces acting on attached hook/loop strip material pairs. Since interlocked hook and loop material strip pairs can best withstand shear forces, the combination of shear, torque and tensile forces tends to cause the strip pairs to work loose, especially when the sheets are installed on waterbed mattresses. As earlier described, the alternating expansion and contraction of the corners of a waterbed mattress, due to wave motion of the water in the mattress, makes it extremely difficult, if not impossible, to maintain the pocket of a sheet in position about the corner of a waterbed.

Accordingly, it would be highly desirable to provide an improved bedding system which would allow bedding to be positioned on a bed without having to lift the corners or end of a mattress or move the bed and would allow bedding to be installed on a waterbed mattress or ordinary mattress such that the bedding would not work loose during use of the bed.

Therefore, it is a principal object of the invention to provide an improved system for positioning bedding on a mattress.

Another object of the invention is to provide an improved bedding system which permits a sheet to be readily and conveniently placed on a mattress without having to lift the corners of the mattress or move the bed away from a wall.

A further object of the invention is to provide an improved bedding system which minimizes the time required to change bedding so that hospitals, convalescent homes and similar institutions which have a substantial number of beds can reduce the time required to intermittently remove soiled sheets and pro- vide the beds with fresh linen.

Still another object of the instant invention is to provide an improved bedding system which allows bedding to be placed on a waterbed mattress such that the bedding will not come loose from the mattress when water shifts in the mattress during use of the bed.

Another, further and more specific object of the invention is to provide an improved bedding system which minimizes the shear, torque and tensile forces which act on hook and loop fastening strips or other attaching material used to secure sheets in place over a mattress.

These and other, further and more specific objects and advantages of the invention will be apparent to those skilled in the art from the following detailed description thereof, taken in conjunction with the drawings, in which.

Briefly, in accordance with the invention, I provide improved means for covering a mattress with a protective layer of material, the covering means permitting the material to be readily placed on and removed from the mattress. The mattress includes a horizontally disposed generally flat upper surface area on which a person may repose; a generally flat lower surface area parallel to the upper surface; and a generally vertically oriented side surface of appreciable thickness spanning between the upper and lower surfaces and continuously extending around the mattress. The covering means includes a sheet of material having a main area shaped and dimensioned to correspond to the flat area of the mattress and having an outer peripheral edge, and having at least one marginal area integral with and extending from the peripheral edge of the main area and dimensioned to cover at least a portion of the side surface of the mattress, the marginal area including at least one strip of attaching material generally parallel to the peripheral edge of the main area of the sheet of material; and means for fixedly, detachably securing the strip of material in position adjacent the side portion of the mattress such that the positioned strip generally continuously encircles the side surface of the mattress and maintains the sheet of material in position on the mattress. The securing means may include an opposing second strip of material which fixedly, detachably receives and secures the strip of attaching material, the opposing strip being attached to the side surface of the mattress. The opposing strip may also be integrally formed in the side surface of the mattress.

In another embodiment of the invention, the securing means includes a mattress liner having a central area shaped and dimensioned to correspond to the lower area of the mattress, the central area having a continuous outer edge; and having at least one marginal portion integral with and extending from the outer edge of the central area and shaped and dimensioned to cover at least a portion of the side surface of the mattress, the marginal portion including an auxiliary strip of material for detachably, fixedly receiving and securing in place the attaching strip of said sheet of material.

Figure 1:
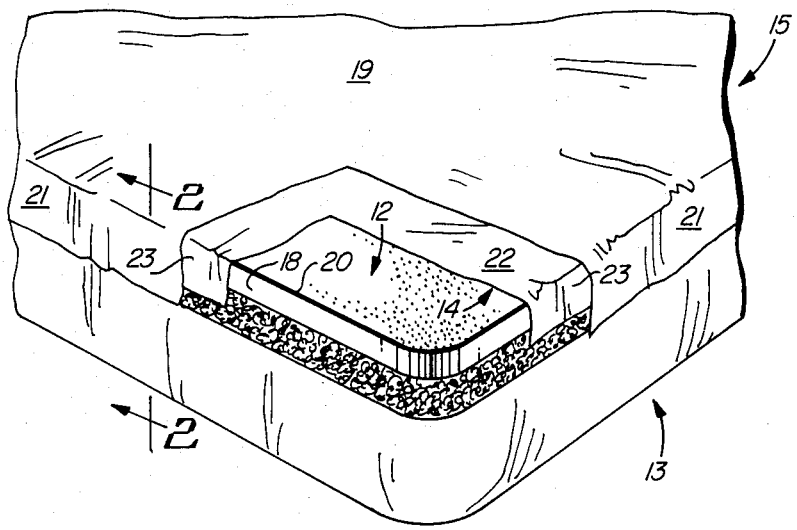
FIG. 1 is a perspective view of the presently preferred embodiment of the invention with portions thereof being broken away to further illustrate the construction thereof.
Figure 2:
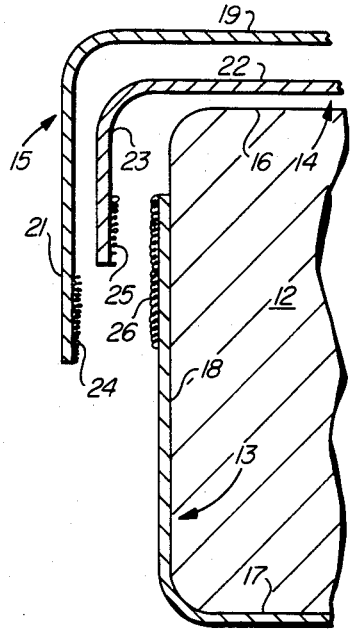
FIG. 2 is a section assembly view of a portion of the bedding of FIG. 1 taken along section line 2—2 thereof.

Turning now to the drawings, which depict the presently preferred embodiment of the invention for the purpose of illustrating the practice thereof and not by way of limitation of the scope of the invention, and in which like reference characters identify corresponding elements throughout the several views, FIGS. 1 and 2 illustrate the presently preferred embodiment of the invention, including spring mattress 12, mattress liner 13, mattress pad 14 and sheet 15. Mattress 12 includes a horizontally disposed, generally flat upper sleeping surface 16, a generally flat lower surface area 17 parallel to surface 16 and vertical side surface 18 which extends continuously around the periphery of mattress 12. Main area 19 of sheet 15 is contoured to correspond to the upper sleeping surface 16 and has an imaginary outer peripheral edge which coincides with the continuous upper edge 20 of mattress 12. Marginal areas or side flaps 21 are integral with and extend from main area 19 of sheet 15 and overlap at least a portion of the side surface 18 of mattress 12. Mattress pad 14 similarly includes a central main area 22 having an imaginary peripheral outer edge which coincides with the continuous outer edge 20 of mattress 12 and having side panels 23 integral with and extending from the imaginary peripheral edge of central area 22. Panels 23 overlap at least a portion of the side surface 18 of mattress 12.

Positive hook material strips 24, 25 are attached to flaps 21, 23 of sheet 19 and mattress pad 22, respectively, and are fixedly, detachably received by negative loop material strip 26 which is mounted on mattress liner 13. When strips 24, 25 are connected to opposing receiving strip 26, each of strips 24–26 is generally parallel to one another, to top edge 20 of mattress 12, and to the imaginary peripheral edges of sheet 19 and mattress pad 22. Strip 26 is continuous and circles the periphery of mattress 12 along with side surface 18. Although receiving strip 26 is carried by removable mattress liner 13 in FIG. 2, strip 26 could, of course, be directly attached to side surface 18 of mattress 12.

Figure 3:
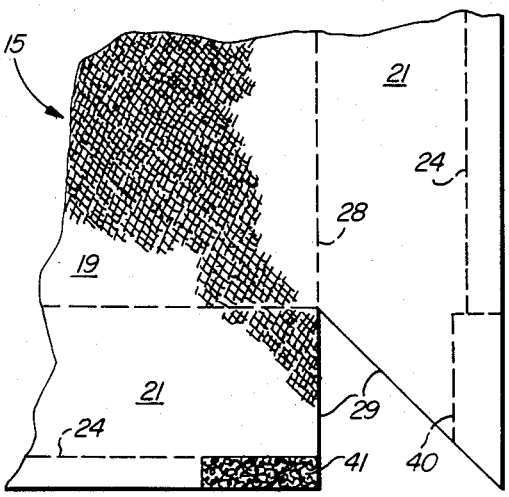
FIG. 3 is a top view of the corner of a sheet design utilized in the presently preferred embodiment of the invention.
Figure 4:
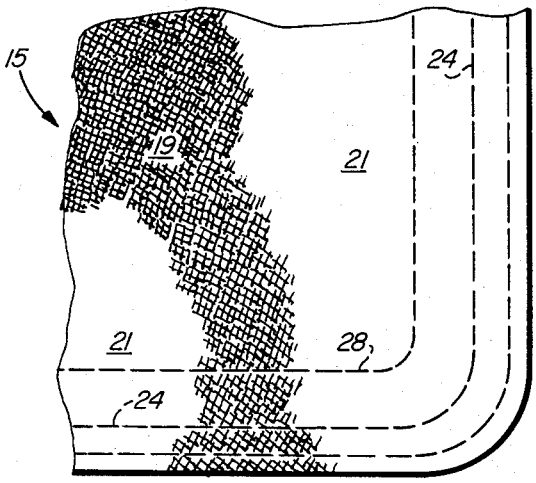
FIG. 4 is a top view of the corner of another sheet design which may be utilized in the presently preferred embodiment of the invention.

As shown in FIGS. 3 and 4, strip 24 of sheet 15 is also generally continuous and circles the imaginary peripheral edge 28 of main area 19 along with and on side flaps 21. V-shaped slit 29 formed in sheet 15 in FIG. 3 permits sheet 15 to be utilized on mattresses on which the receiving negative loop strip 26 material is positioned on side 18 near to bottom surface 17 of the mattress. When sheet 19 of FIG. 3 is positioned on a mattress, positive hook pad 40 is pulled around a corner of the mattress and connected to negative loop material pad 41.

Figure 5:
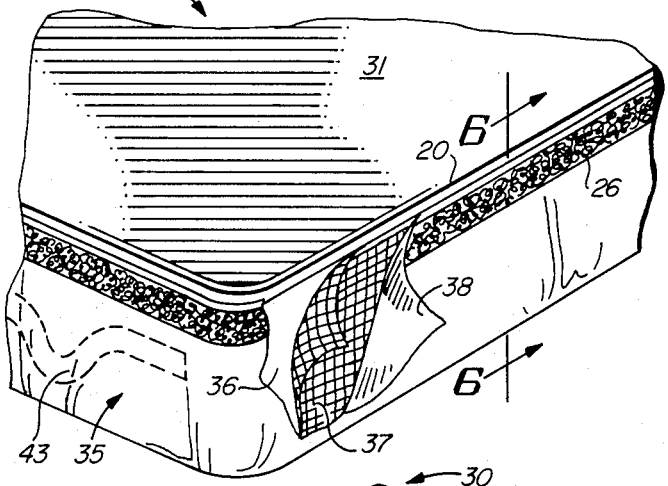
FIG. 5 is a perspective view of another embodiment of the invention particularly suited for covering waterbed mattresses with sheets.
Figure 6:
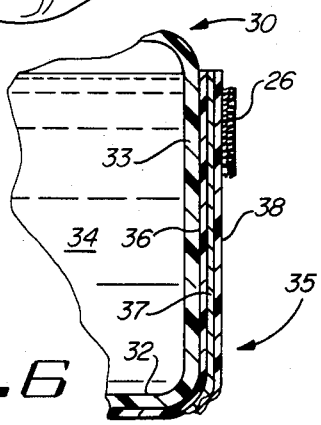
FIG. 6 is a sectional view of the bedding of FIG. 5 taken along section line 6-6 thereof; and, FIG. 7 is a section assembly view of another embodiment of the invention.

FIGS. 5 and 6 illustrate an alternate embodiment of the invention adapted for use on a waterbed mattress 30 including horizontally disposed upper surface 31, lower surface 32 parallel to upper surface 30 and vertical side surface 33 interconnecting and spanning between surfaces 31, 32. Mattress 30 is filled with water 34 and is provided with a removable mattress liner 35 including an inner layer of vinyl material 36, intermediate mesh layer of stiffening fabric 37 and outer layer of vinyl material 38. The waterbed frame for supporting mattress 30 is omitted for the sake of clarity. Layers 36–38 provide a substantially stiff waterbed liner and maintain continuous loop strip 26 material in a relatively constant position.

Although the hook and loop strips shown in FIGS. 1–6 are parallel to the imaginary outer peripheral edges 28 of sheet 15 and/or parallel to the upper edge 20 of mattresses 12, 30, the hook and loop strips could, as indicated by dashed lines 43 of FIG. 5, be undulating or otherwise shaped and dimensioned in a manner which would still permit the strips to be generally parallel to the outer peripheral edges 28 of sheets 15 and/or to the upper peripheral edge 20 of mattresses 12, 30.

The use of hook and loop material strip pairs which substantially circle side surface 18 of mattress 12 or side surface 33 of mattress 30 tends, to distribute forces acting on sheet 15 evenly along the length of hook and loop material strip pairs 24, 26 and 25, 26 and to eliminate concentration of shear and tensile forces in the corner areas of sheet 15.

Figure 7:
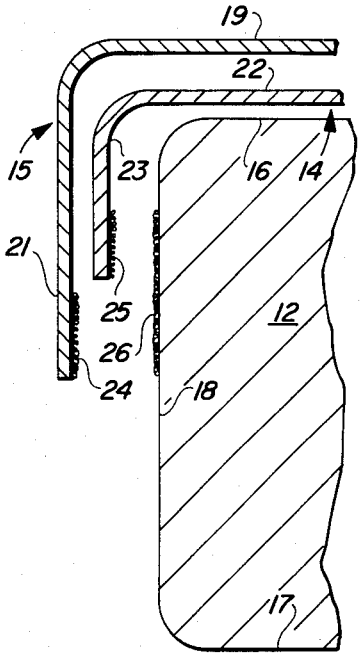

FIG. 7 illustrates an alternate embodiment of the invention in which hook and loop fastener strip 26 is attached directly to side 18 of mattress 12.

Having described my invention in such terms as to enable those skilled in the art to which it pertains to understand and practice it, and having described the presently preferred embodiments thereof, I claim:

1. In combination with a mattress including a generally horizontally disposed flat upper surface area on which a person may repose, flat lower surface area parallel to said upper surface area, and, vertically oriented side surface of appreciable thickness interconnecting and spanning the distance between said upper and lower surfaces and continuously extending around said mattress, means for covering said mattress with protective layers of material, said means permitting said material to be readily placed on and removed from said mattress and including (a) a bottom sheet of material having top and bottom surfaces and including (i) a main central area shaped and dimensioned to correspond to the flat upper surface area of the mattress and having an outer peripheral edge, and (ii) a marginal area integral with and extending from said peripheral edge of said main area and dimensioned to cover a portion of said side surface of said mattress, said marginal area including a first strip of hook fastening material extending continuously along said marginal area generally parallel to said peripheral edge of said main area of said sheet, said hook strip being attached to said bottom surface of said bottom sheet, and a peripheral edge positioned adjacent said vertically oriented side surface between said upper and lower surfaces of said mattress when said bottom sheet is properly positioned on said mattress, said peripheral edge of said marginal area generally being spaced apart from said peripheral edge of said main central area of said bottom sheet by a selected distance less than said distance between said upper and lower surface areas of said mattress;

(b) a top sheet of material having top and bottom surfaces and including (i) a main central area shaped and dimensioned to correspond to the flat upper surface area of the mattress and having an outer peripheral edge, and (ii) at least one marginal area integral with and extending from said peripheral edge of said main area of said top sheet and dimensioned to cover a portion of said side surface of said mattress, said marginal area including a second strip of hook fastening material extending continuously along said marginal area of said top sheet generally parallel to said peripheral edge of said central area of said top sheet, said second strip of hook material being attached to said bottom surface of said top sheet, a peripheral edge positioned adjacent said vertically oriented side surface between said upper and lower surfaces of said mattress when said top sheet is properly positioned on said mattress over said bottom sheet, said peripheral edge of said marginal area of said top sheet generally being spaced apart from said peripheral edge of said main central area of said top sheet by a selected distance greater than said distance between said peripheral edge of said marginal area of said bottom sheet and said peripheral edge of said central area of said bottom sheet, and no more than said distance between said upper and lower surfaces of said mattress, said second strip of hook material generally being positioned on said top sheet a distance from said peripheral edge of said central area of said top sheet greater than said distance between said peripheral edge of said marginal area of said bottom sheet and said peripheral edge of said central area of said bottom sheet;

(c) means for fixedly detachably securing said first and second strips of hook material in position adjacent said side portion of said mattress, said securing means including first and second strips of loop material attached to and extending continuously along said side surface of said mattress such that (i) said first strip of hook material is attached to said first strip of loop material when said bottom sheet is properly positioned on said mattress, (ii) said second strip of hook material is attached to said second strip of loop material when said top sheet is properly positioned on said mattress, (iii) said first and second strips of said loop material are generally parallel to one another and to said upper and lower surfaces of said mattress, (iv) said first strip of loop material is attached to said side surface of said mattress above said second strip of loop material.

(v) said first and second hook strips generally lie in a common vertical imaginary plane when attached to said first and second loop strips, and (vi) said marginal area of said top sheet between said first hook strip and said peripheral edge of said central area of said top sheet is adjacent and generally contacts said marginal area of said bottom sheet when said first and second hook strips are attached to said first and second loop strips.

2. The combination of claim 1 wherein said hook strips are replaced with loop strips and said loop strips are replaced with hook strips.

* * * * *